US006338773B1

(12) United States Patent
Sbaschnigg et al.

(10) Patent No.: US 6,338,773 B1
(45) Date of Patent: Jan. 15, 2002

(54) DEVICE FOR DEWATERING SOLID/LIQUID SUSPENSIONS, ESPECIALLY PULP SUSPENSIONS

(75) Inventors: Johann Sbaschnigg, Graz; Franz Petschauer, Lannach; Georg Reck, Graz, all of (AT)

(73) Assignee: Andritz-Patentverwaltungs-Gesellschaft m.b.H., Graz (AT)

( * ) Notice: Subject to any disclaimer, the term of this patent is extended or adjusted under 35 U.S.C. 154(b) by 0 days.

(21) Appl. No.: 09/445,971

(22) PCT Filed: Jul. 1, 1998

(86) PCT No.: PCT/EP98/04045

§ 371 Date: Mar. 16, 2000

§ 102(e) Date: Mar. 16, 2000

(87) PCT Pub. No.: WO99/01609

PCT Pub. Date: Jan. 14, 1999

(30) Foreign Application Priority Data

Jul. 1, 1997 (AT) ..... A1122/97

(51) Int. Cl.[7] ..... D21F 1/00

(52) U.S. Cl. ..... 162/300; 162/308; 162/315; 162/205; 162/203; 162/202; 162/358.1; 210/400; 210/401; 210/211; 100/138

(58) Field of Search ..... 162/300, 205, 162/203, 202, 358.1, 358.2, 358.3, 308, 315; 210/400, 401, 211; 100/138

(56) References Cited

U.S. PATENT DOCUMENTS 4,481,118 A * 11/1984 Heissenberger et al. .... 210/783
4,834,884 A * 5/1989 Bergloff et al. ..... 210/401

* cited by examiner

*Primary Examiner*—Stanley S. Silverman
*Assistant Examiner*—M. Halpern
(74) *Attorney, Agent, or Firm*—Alix, Yale & Ristas, LLP

(57) ABSTRACT

A device for dewatering solid/liquid suspensions, especially pulp suspensions, where the suspension is dewatered between two belts, with one dewatering zone being a wedge zone. A pair of rolls downstream of the wedge zone impart both area pressure and line pressure on the pulp web formed by the pulp suspension.

15 Claims, 3 Drawing Sheets

PRIOR ART

DEVICE FOR DEWATERING SOLID/LIQUID SUSPENSIONS, ESPECIALLY PULP SUSPENSIONS

CROSS REFERENCE TO RELATED APPLICATION

This is the national phase of International Application No. is a 371 of PCT/EP98/04045 filed Jul. 1, 1998.

BACKGROUND of the INVENTION

The invention relates to a device for dewatering solid/liquid suspensions especially pulp suspensions, where the suspension is dewatered between two belts, one dewatering zone being designed as wedge zone.

This type of device is known, for instance, from AT 402.517. To achieve a high dryness, so-called S-module rolls with area pressing are used here, and subsequently also several press nips with line pressing. Due to the multiplicity of deflection and press rolls, the machine is comparatively long.

SUMMARY of the INVENTION

The aim of the invention is, therefore, to simplify the known device and to achieve a shorter and more compact design and thus to reduce costs.

According to the invention, this is achieved by the pair of rolls following the wedge zone imparting both area pressure and line pressure on the pulp web formed by the pulp suspension. By combining the S-module rolls imparting the area pressure with a press nip with line pressing force two rolls can be done without, which gives a far shorter and more compact design. With fewer rolls and bearings, costs can be saved.

An advantageous design of the invention is characterized by the wedge height at the outlet end, especially over the entire web width, being adjustable in its height. This allows production of the most varied basis weights.

A favorable advancement of the invention is characterized by the first combined deflection and press roll of the pair of rolls being arranged below the end of the wedge zone and directly adjacent to it, with the wedge zone possibly being extended beyond the first subsequent combined deflection and press roll and the opposite part reaching into the gap between the wire belt and the roll. This further shortens the machine, whereby through this design the pulp web between the wires is stabilized as far as into the first combined deflection and press roll, preventing the fibers from being shoved back and subsequently also lateral squeezing out of the pulp material ahead of the S-module and the press nip. Also, this prevents subsequent stretching of the kilter cake and thus re-wetting. Especially with hard to dewater material, the throughput performance of the dewatering unit is thereby increased.

An advantageous advancement of the invention is characterized by the wrap angle of the first combined deflection and press roll being between 10 and 90 degrees, preferably approximately 60 degrees.

An further advancement of the invention is characterized by the wrap angle of the second combined deflection and press roll being between 30 and 120 degrees, preferably approximately 100 degrees.

An advantageous development of the invention is characterized by the wrap angle/e being changeable, especially adjustable.

A favorable design of the invention is characterized by only one upper and/or lower deflection roll at the beginning of the wedge being in each case provided as stretcher roll immediately at the beginning of the wedge. This means that further rolls can be saved, which causes the system to be shortened accordingly and leads to essential cost savings.

A favorable advancement of the invention is characterized by the upper part of the wedge being especially automatically adjustable, for instance, elastically and by the opposite part being fixed.

BRIEF DESCRIPTION OF THE DRAWINGS

The invention is described in the following in examples based on the drawings, in which.

DETAILED DESCRIPTION OF THE PREFERRED EMBODIMENT

Figure 1:
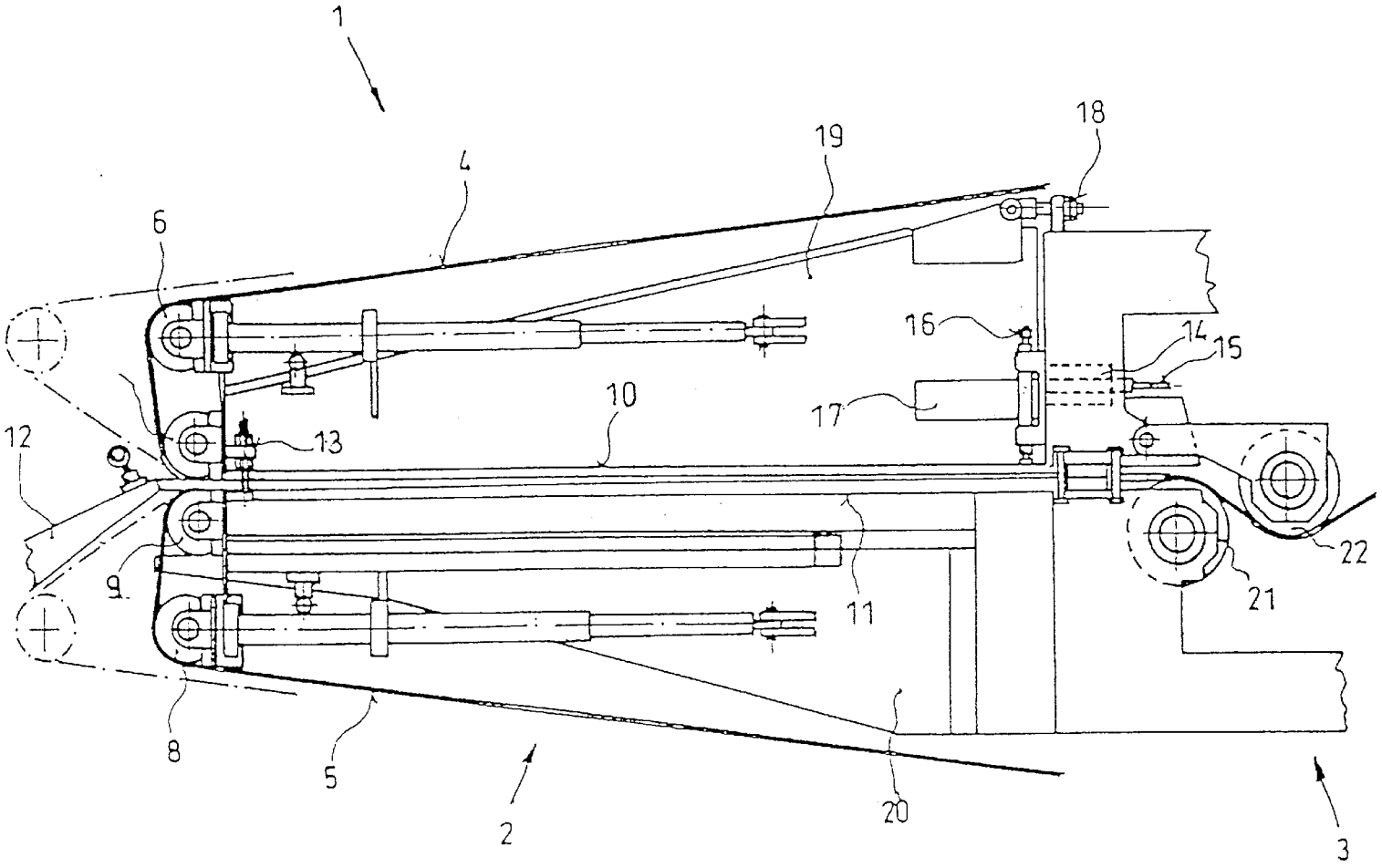
FIG. 1 shows a dewatering device according to the state of the art, FIG. 2 a dewatering device as per the invention.

The dewatering device 1 with a wedge area 2 and a further dewatering area, especially an S-module area 3, is shown in FIG. 1. Here the upper wire or filter belt 4 runs over an upper deflection roll 6 whose position can be adjusted and regulated, and subsequently over a deflection roll 7 into the wedge formed by the plates 10 and 11. The second wire or filter belt 5 runs over a pertinent deflection roll 8 and a further deflection roll 9 also into the wedge. The material to be dewatered, for instance pulp, is also fed into the wedge through a headbox 12. The upper part 10 of the wedge and the lower part 11 of the wedge are mechanically connected via a threaded spindle 13 and their spacing can be adjusted. After leaving the gap the belts 4 - and 5 with the interposed pulp web are deflected around S-module rolls 21 and 22, which induces further dewatering. Here the upper part 10 of the wedge is adjustable in its height by a pneumatic or hydraulic hose. The compressed air or hydraulic fluid is fed through a connection 15. To limit the minimum respectively maximum adjustment, stop screws 16 are used. A glide plate 17 serves to take up the axial forces. Furthermore a support 18 for cantilevering, i.e. for exchanging the endless wire belts, is provided. To ensure the least possible influence on the ambience, a hood 19 is integrated into the upper part 10 of the wedge and a filtrate tray 20 into the lower part 11 of the wedge.

Figure 2:
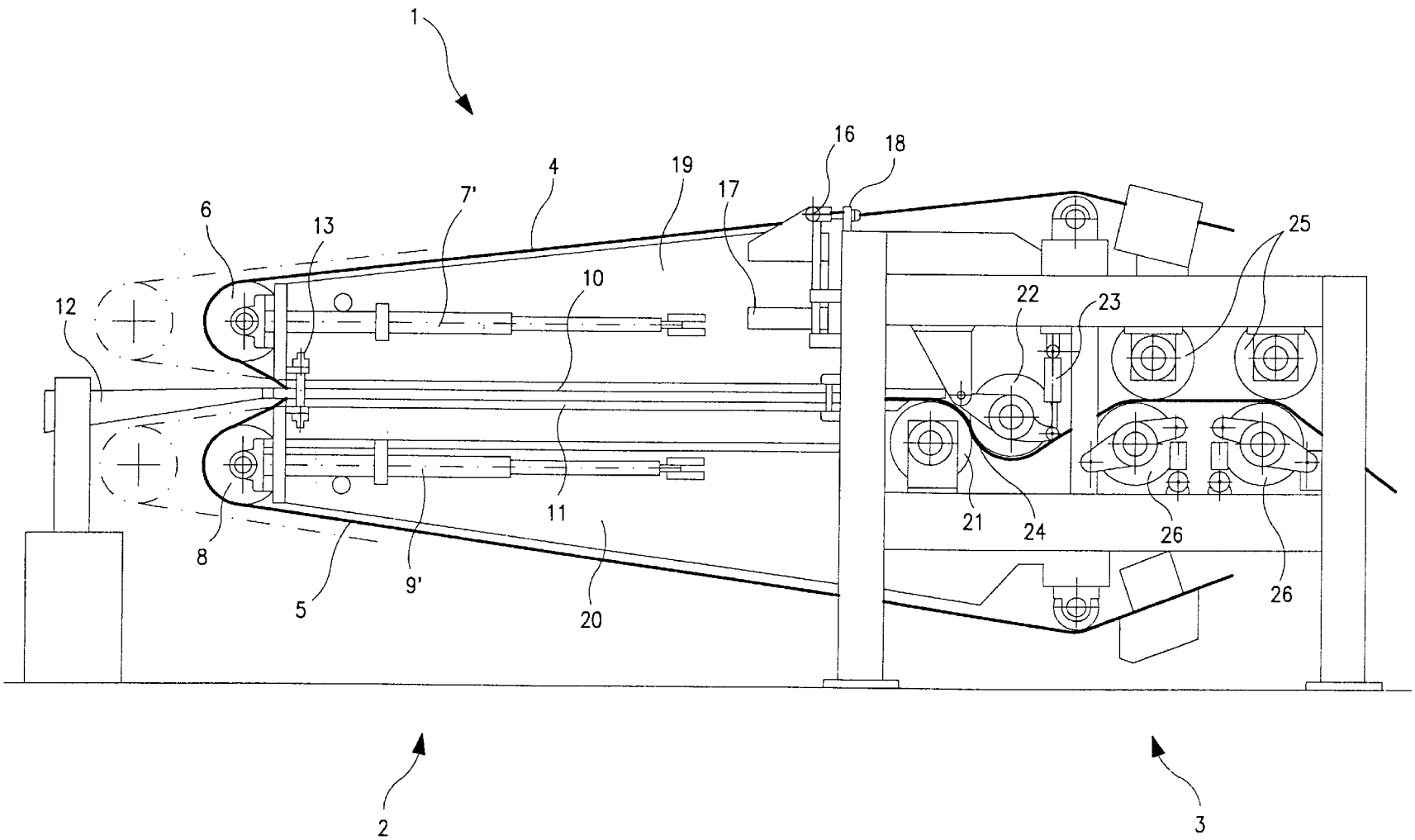
Figure 3:
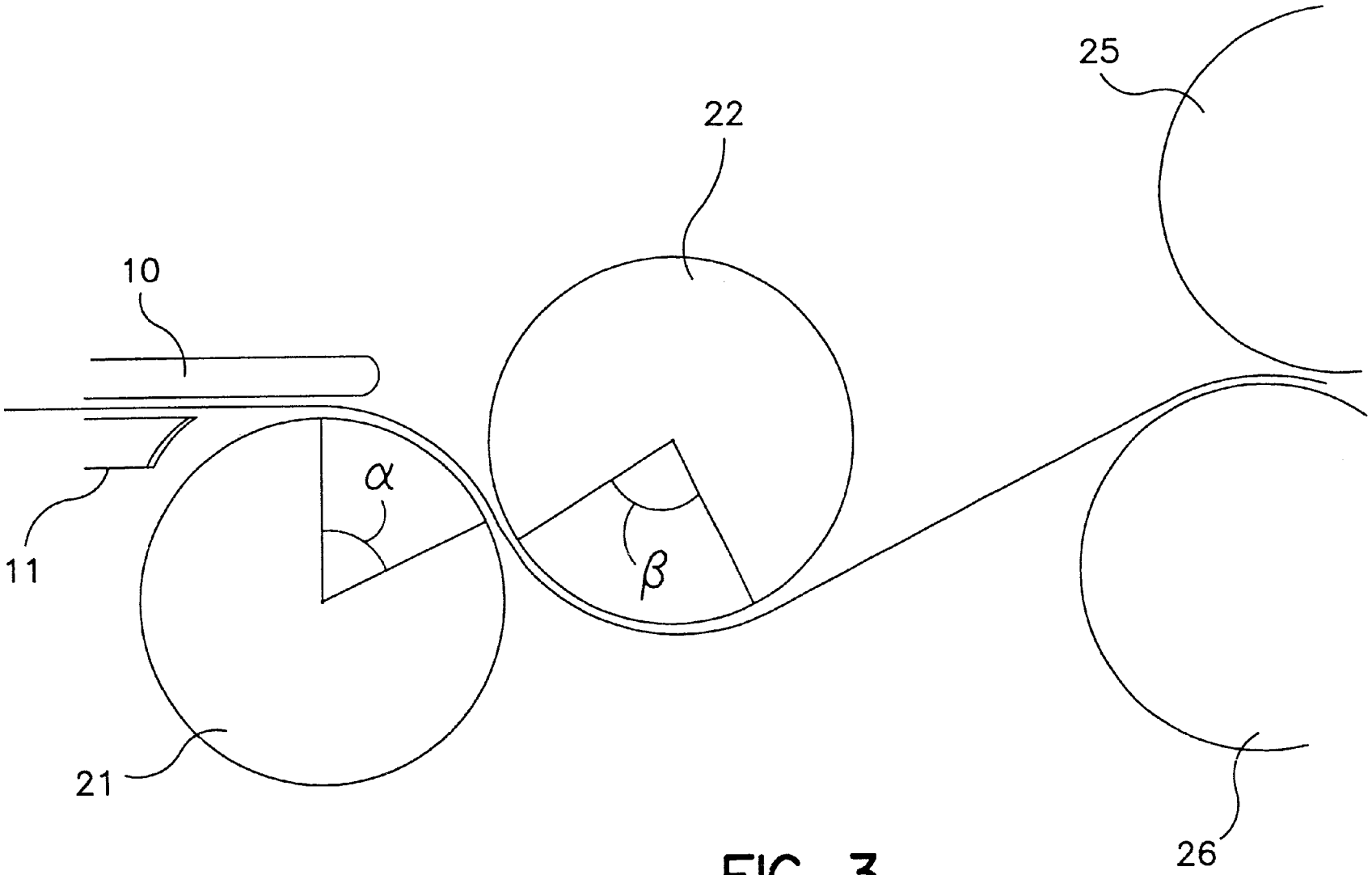
FIG. 3 is a simplified, enlarged view of part of the S-module area of FIG. 2.

It can be seen from FIG. 2 that the upper deflection roll 6, whose position can be adjusted and regulated by a hydraulic or a pneumatic cylinder 7', is the only deflection roll for the upper wire belt 4. There is consequently no longer a lower deflection roll, whereby-a far more compact design can be achieved. The same applies by analogy to the lower deflection roll 8, which can be adjusted and regulated by a hydraulic or a pneumatic cylinder 9'. The two S-module rolls 21, 22 are in this case designed as combined deflection and press rolls. Pressing the roll 22 to roll 21 is done by hydraulic cylinder 23, giving a nip 24 with additional line force. Following this, further pairs of press rolls 25, 26 are provided so that at the end of the dewatering device the desired dryness can be achieved.

Here, the first combined deflection and press roll 21 of the roll pair is arranged below the end of the wedge zone 10, 11 and directly adjacent to it, with the wedge plate 10 being extended beyond the combined deflection and press roll 21 and the opposite part of the wedge plate 11 reaching into the gap between wire belt 5 and roll 21. The wrap angle $\alpha$ of the first combined deflection and press roll 21 is approximately 60 degrees, the wrap angle $\beta$ of the second combined deflection and press roll 22 approximately 100 degrees. The invention is not limited to the examples, for instance, the arrangement of the combined deflection and press rolls could be reversed, i.e. the first roll could be arranged on the top. Other adjustment and pressing mechanisms for the deflection and press roll are also possible.

What is claimed is:

1. Device for dewatering solid/liquid suspensions comprising:

a pair of belts defining at least one dewatering zone, said dewatering zone including a wedge zone, and roll means for imparting both area pressure and line pressure on the pulp web formed by the pulp suspension, said roll means comprising a first and a second roll.

2. Device according to claim 1, wherein the wedge has inlet and outlet ends and a height at the outlet end which is adjustable.

3. Device according to claim 1, wherein the first roll is a combined deflection and press roll disposed below the outlet end of the wedge zone and directly adjacent to it.

4. Device according to claim 3, wherein the wedge zone comprises upper and lower wedge plates, the upper wedge plate extending beyond the first roll and the opposite lower wedge plate reaching into the gap between the wire belt and the roll.

5. Device according to claim 1, wherein the first roll has a wrap angle between 10 and 90 degrees.

6. Device according to claim 1, wherein the second roll has a wrap angle between 30 and 120 degrees.

7. Device according to claim 5, wherein the wrap angle of the first roll is adjustable.

8. Device according to claim 1, further comprising upper and lower deflection rolls, the wedge having inlet and outlet ends, the upper and lower deflection rolls being disposed at the inlet end of the wedge.

9. Device according to claim 1, wherein the wedge zone comprises upper and lower wedge plates, the upper wedge plate extending beyond the first roll and the opposite lower wedge plate reaching into the gap between the wire belt and the roll, the upper wedge plate being automatically adjustable and the lower wedge plate being fixed.

10. Device according to claim 2, wherein the wedge height at the outlet end is adjustable over the entire web width.

11. Device according to claim 5, wherein the wrap angle of the first roll is substantially equal to 60 degrees.

12. Device according to claim 6, wherein the wrap angle of the second roll is substantially equal to 100 degrees.

13. Device according to claim 5, wherein the wrap angle of the second roll is adjustable.

14. Device according to claim 8, wherein said upper and lower deflection rolls are stretcher rolls.

15. Device according to claim 9, wherein the upper wedge plate is elastically adjustable.

* * * * *